US005440378A

United States Patent [19]

Matsuura

[11] Patent Number: 5,440,378

[45] Date of Patent: Aug. 8, 1995

[54] DEVELOPING DEVICE ACCOMMODATING A TWO COMPONENT DEVELOPER AND METHOD OF USING SAME

[75] Inventor: Masahiko Matsuura, Takatsuki, Japan

[73] Assignee: Minolta Camera Kabushiki Kaisha, Osaka, Japan

[21] Appl. No.: 130,443

[22] Filed: Oct. 1, 1993

[30] Foreign Application Priority Data

Oct. 6, 1992 [JP] Japan ..... 4-267226

[51] Int. Cl.[6] ..... G03G 15/09

[52] U.S. Cl. ..... 355/251; 118/657

[58] Field of Search ..... 355/245, 251, 253; 118/657

[56] References Cited

U.S. PATENT DOCUMENTS

| | | | |
|---|---|---|---|
| 5,009,973 | 4/1991 | Yoshida et al. | 430/45 |
| 5,036,369 | 7/1991 | Toda et al. | 355/251 X |
| 5,038,176 | 8/1991 | Yokoyama et al. | 355/251 |

FOREIGN PATENT DOCUMENTS

| | | | |
|---|---|---|---|
| 59-67565 | 4/1984 | Japan . | |
| 63-187262 | 8/1988 | Japan . | |
| 1-297657 | 11/1989 | Japan | 355/245 |

*Primary Examiner*—Fred L. Braun

*Attorney, Agent, or Firm*—Burns, Doane, Swecker & Mathis

[57] ABSTRACT

A developing device accommodating a two-component developer of a carrier and a toner the mean particle diameter of which is 3~5 μm. The developing device has a rotatable developing roller confronting the photoreceptor for supplying the developer to the electrostatic latent image on the photoreceptor at a developing region where the developing roller confronts the photoreceptor while holding the developer thereon and adjusting member for adjusting a developer packaged density (PD) in the developing region at 40~50. The developer packaged density (PD) is obtained via the following equation:

$$PD=100M/(\rho \cdot D_S)$$

wherein the following obtains:

M: amount of developer on the developing roller per unit of surface area (g/cm$^2$)

$\rho$: carrier's true specific gravity (g/cm$^3$)

$D_S$: spacing between developing roller and photoreceptor (cm). A method for developing an electrostatic latent image uses the developing device to provide a suitable developer packaged density (PD).

18 Claims, 1 Drawing Sheet

DEVELOPING DEVICE ACCOMMODATING A TWO COMPONENT DEVELOPER AND METHOD OF USING SAME

BACKGROUND OF THE INVENTION

1. Field of the Invention

The present invention relates to a developing device for developing electrostatic latent images formed on the surface of a latent image carrying member using a two-component developing material.

2. Description of the Related Art

In recent years, small particle-diameter toners have been actively developed to produce highly detailed images in copying apparatus and printers using electrophotographic methods.

Toner increases its surface area per unit weight the smaller the particle diameter, and the amount of the electrical load of the individual toner particles increases, which tends to reduce image density.

There are a number of methods to counteract this tendency, such as a method wherein the developing potential is increased to increase the electrostatic adhesion force of the toner on the electrostatic latent image carrying member, and a method wherein the ratio (speed ratio) of the speed of movement of the developer relative to the speed of movement of the electrostatic latent image carrying member to increase the amount of developing material in contact with the electrostatic latent image carrying member per unit time.

The former method, however, has certain disadvantages inasmuch as it increases the amount of ozone produced by charging, as well as problems of carrier adhesion and fatigue of the electrostatic latent image carrying member, whereas the latter method has certain disadvantages inasmuch as line image reproducibility is reduced, and toner scattering increases. Another method increases the weight content of the toner relative to the carrier (hereinafter referred to as "toner density"), which produces certain disadvantages such as toner scattering via inadequate charging, and carrier fatigue.

SUMMARY OF THE INVENTION

An object of the present invention is to provide a developing device capable of developing with a high degree of detail and suitable image density.

Another object of the present invention is to provide a developing device capable of developing with suitable image density using a small particle-diameter toner.

These and other objects of the present invention are achieved by providing a developing device comprising accommodating means for accommodating a two-component developer of a carrier and a toner the mean particle diameter of which is 3~5 μm, a rotatable developing roller confronting a photoreceptor for supplying the developer to an electrostatic latent image on the photoreceptor at a developing region where said developing roller confronts the photoreceptor while holding the developer thereon, adjusting means for adjusting a developer packaged density (PD) in said developing region at 40~50, said developer packaged density (PD) being obtained via the following equation:

$$PD=100M/(\rho \cdot D_s)$$

wherein the following obtains:

M: amount of developer on the developing roller per unit of surface area (g/cm$^2$)

$\rho$: carrier's true specific gravity (g/cm$^3$)

$D_s$: spacing between developing roller and photoreceptor (cm).

The aforesaid objects of the present invention are further achieved by providing a developing device comprising accommodating means for accommodating a two-component developer of a carrier and a toner the mean particle diameter of which is 5~8 μm, a rotatable developing roller confronting a photoreceptor for supplying the developer to an electrostatic latent image on the photoreceptor at a developing region where said developing roller confronts the photoreceptor while holding the developer thereon, adjusting means for adjusting a developer packaged density (PD) in said developing region at 35~45, said developer packaged density (PD) being obtained via the following equation:

$$PD=100M/(\rho \cdot D_s)$$

wherein the following obtains:

M: amount of developer on the developing roller per unit of surface area (g/cm$^2$)

$\rho$: carrier's true specific gravity (g/cm$^3$)

$D_s$: spacing between developing roller and photoreceptor (cm).

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiment of the present invention is described hereinafter with reference to the accompanying drawings.

Figure 1:
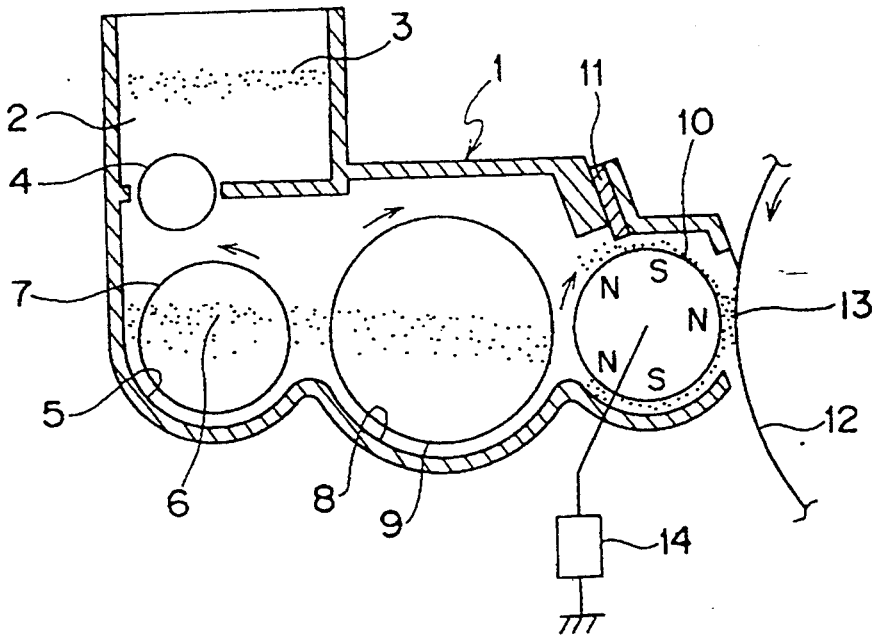
FIG. 1 is a section view showing the developing device of the present invention.

In the developing device 1 of FIG. 1, the toner supply section 2 accommodates the toner 3, which is supplied to the rear transport path 5 via the supply roller 4.

The two-component developer 6 comprising a toner and a carrier is accommodated in the rear transport path 5. The developer 6 is supplied to the front transport path 8 while being mixed with the toner 3 supplied from the toner supply section 2 via the rotating transport member 7.

The developer 6 supplied to the front transport path 8 is again mixed via the rotating transport member 9 so as to be delivered to the developing roller 10.

The developer 6 supplied to the developing roller 10 is maintained on the exterior surface of said developing roller 10 via the magnetic force exerted by a built-in magnet, so as to be transported in the clockwise direction. The developer 6 is regulated to a uniform amount by means of the regulating blade 11, and thereafter comes into contact with an electrostatic latent image formed on the surface of the photosensitive member 12 at the developing section 13, thereby developing said electrostatic latent image. The aforesaid developing is accomplished electrically based on an electric potential difference between the surface potential of the photosensitive member 12 and the bias applied to the developing roller 10 via the power source 14.

Then, the developer 6 which has passed the developing section 13, continues to be transported in the clockwise direction, and is removed from the developing roller 10 at the position where the developing roller 10 is opposite the aforesaid front transport section 8.

Toner having a mean particle diameter of 3~5 μm and toner having a mean particle diameter of 5~8 μm, respectively, were used to change the packaged density PD in evaluation tests of line image reproducibility, fog generation conditions, and image density. A typical toner having a normal mean particle diameter of 10~12 μm was also similarly evaluated for comparison purposes.

The aforesaid toners were comprised as described below (parts-by-weight=pbw).

| | |
|---|---|
| Styrene-acrylic resin: | 100 pbw |
| Carbon black: | 8 pbw |
| Load controlling agent: | 5 pbw |
| Load controlling resin: | 2 pbw |
| Offset preventing agent: | 4 pbw |

A post-processing agent (silica) in the amount of 0.5 pbw was added to the small particle diameter toners having mean particle diameters of 3~5 μm and 5~8 μm, respectively, and said post-processing agent in the amount of 0.15 pbw was added to the typical toner having a normal particle diameter of 10~12 μm.

The carrier was a smooth-surfaced ferrite particle (60 emu/g) coated with a silicone resin, and with particle diameters of 40~80 μm (mean particle diameter: 55 μm) was used. The true specific gravity of the carrier is 2 g/cm$^3$.

The developing conditions of the developing device used in the tests are described below.

| | |
|---|---|
| Photosensitive member charge potential: | −630 V |
| Exposure portion of photosensitive member charge potential: | −100 V |
| Developing bias: | −450 V |
| Developing roller speed/photosensitive member speed: | 1.5 |

The packaged density PD is defined by the equation below:

$$PD=100M/(\rho \cdot D_s)$$

wherein the following obtains:

PD: packaged density

M: amount of developer on the developing roller per unit of surface area (g/cm$^2$)

$\rho$: carrier's true specific gravity (g/cm$^3$)

$D_S$: spacing between developing roller and photosensitive member (cm).

Regulation of the packaged density PD is accomplished in accordance with Table 1 via experimental determinations of the relationship among the brush-height regulating gap $D_B$, developing gap $D_S$, and packaged density PD.

Figure 2:
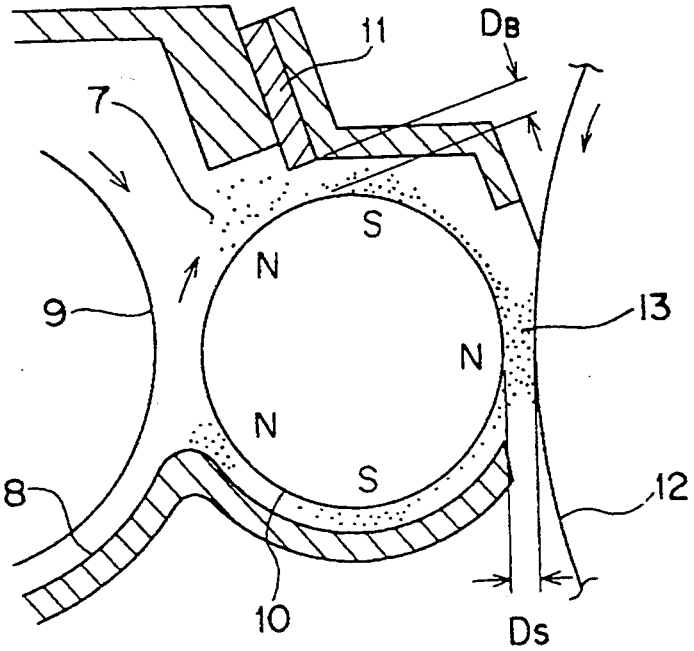
FIG. 2 is a partial enlargement of the developing device of FIG. 1.

As shown in FIG. 2, the aforesaid brush-height regulating gap $D_B$ expresses the spacing between the developing roller 10 and the regulating blade 11. The aforesaid developing gap $D_S$ expresses the spacing between the developing roller 10 and the photosensitive member 12. Further, in the experiment, the adjustment of the true specific gravity is replaced by the adjustment of brush-height regulating gap $D_B$.

TABLE 1

| $D_S$ (mm) | Relationship Among $D_B$, $D_S$ and PD: $D_B$ (mm) [M(g/cm$^2$)] 0.2 [0.045] | 0.3 [0.060] | 0.4 [0.075] | 0.5 [0.100] |
|---|---|---|---|---|
| 0.2 | 45 | 60 | 75 | — |
| 0.3 | 30 | 40 | 50 | 67 |
| 0.4 | 23 | 30 | 38 | 50 |
| 0.5 | 18 | 24 | 30 | 40 |
| 0.6 | 15 | 20 | 25 | 33 |
| 0.7 | 13 | 17 | 22 | 28 |
| 0.8 | — | 15 | 19 | 25 |

The evaluation of line image reproducibility, fog generation conditions, and image density are described hereinafter.

Line image reproducibility was evaluated by forming on the surface of a photosensitive member an electrostatic latent image for vertical lines extending in the rotation direction of the photosensitive member, and an electrostatic latent image for horizontal lines extending in the axial direction of the photosensitive member, developing said latent images, and evaluating the differences (absolute values) between the original line widths and the mean line widths after developing. The evaluation symbols used in the table showing the line image reproducibility results are described below.

| Evaluation symbol | Line width difference (μm) |
|---|---|
| ○ | 0~10 |
| Δ | 10~20 |
| X | 20+ |

Fog generating conditions were evaluated by visual inspection of the paper used to reproduce the image. The evaluation symbols used in the table showing the fog generating conditions are described below.

| Evaluation symbol | Degree of fog |
|---|---|
| ○ | No fog |
| Δ | Slight fog, but level not sufficient to be a problem in practice |
| X | Severe fog |

Image density was measured using an image density measuring device (Sakura densitometer model PDA-65, Konishiroku K.K.). The evaluation symbols used in the table showing the image density are described below.

| Evaluation symbol | Image density ID |
|---|---|
| ○ | Above 1.35 |
| Δ | 1.2~1.35 |
| X | Less than 1.2 |

Table 2 shows the evaluation results when the toner mean particle diameter is 3~5 μm.

TABLE 2

| Packaged Density | Line Image Reproducibility | Fog Conditions | Image Density |
|---|---|---|---|
| 24 | X | Δ | X |

TABLE 2-continued

| Packaged Density | Line Image Reproducibility | Fog Conditions | Image Density |
|---|---|---|---|
| 30 | X | ○ | Δ |
| 38 | Δ | ○ | Δ |
| 45 | ○ | ○ | ○ |
| 50 | ○ | ○ | ○ |
| 60 | X | X | ○ |

Table 3 shows the evaluation results when the toner mean particle diameter is 5~8 μm.

TABLE 3

| Packaged Density | Line Image Reproducibility | Fog Conditions | Image Density |
|---|---|---|---|
| 18 | X | X | X |
| 24 | X | Δ | Δ |
| 30 | Δ | Δ | Δ |
| 38 | ○ | ○ | ○ |
| 40 | ○ | ○ | ○ |
| 45 | ○ | ○ | ○ |
| 50 | Δ | X | ○ |

Table 4 shows the evaluation results when the toner mean particle diameter is 10~12 μm.

TABLE 4

| Packaged Density | Line Image Reproducibility | Fog Conditions | Image Density |
|---|---|---|---|
| 13 | X | X | X |
| 15 | X | X | Δ |
| 17 | Δ | Δ | Δ |
| 20 | ○ | ○ | ○ |
| 22 | ○ | ○ | ○ |
| 25 | ○ | ○ | ○ |
| 30 | Δ | ○ | ○ |

The results of the aforesaid evaluations indicate that a suitable packaged density differs for each toner particle diameter. It can be understood that small particle diameter toner having a diameter of 3~5 μm has a suitable packaged density of 40~50, and having a diameter of 5~8 μm has a suitable packaged density of 35~45, whereas typical toner having a normal particle diameter of 10~12 μm has a suitable packaged density of 20~25.

In the aforesaid suitable ranges of packaged density, the previously described disadvantages of conventional developing devices such as toner scattering, carrier adhesion and the like did not occur.

Similar results were obtained when the carrier was coated by a polyolefin type resin, and when the combined toner and ferrite powder were coated by a styrene-acrylic resin solution as described below.

| | |
|---|---|
| styrene acryl-modified polyester resin: | 100 pbw |
| Organic pigment Lionol Yellow FG-1310: | 2.5 pbw |
| Charge controlling agent: (Bontoron E-84, Oriental Chemical K.K.) | 3 pbw |
| Hydrophobic silica: | 0.5 pbw |

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device for developing an electrostatic latent image formed on a photoreceptor, comprising:

an accommodating portion which accommodates a two-component developer of a toner and a carrier;

a rotatable developing roller confronting said photoreceptor and supplying the developer to said electrostatic latent image on the photoreceptor at a developing region where said developing roller confronts the photoreceptor while holding the developer thereon; and means for providing a developer packaged density (PD) in said developing region at 40–50 when the mean toner particle diameter is 3–5 μm, said developer packaged density (PD) being defined by the following equation:

$$PD=100M/(\rho \cdot D_s)$$

wherein:

M is an amount of developer on the developing roller per unit of surface area (g/cm$^2$)

$\rho$ is the carrier's true specific gravity (g/cm$^3$), and $D_s$ is a spacing between the developing roller and the photoreceptor (cm).

2. A developing device as claimed in claim 1 further comprising a blade member which regulates an amount of the developer held on the developing roller.

3. A developing device as claimed in claim 1 wherein the developing roller has a magnetic roller fixed inside thereof.

4. A developing device as claimed in claim 3 wherein a magnetic pole of said magnetic roller confronts the photoreceptor in the developing region.

5. A developing device as claimed in claim 1 wherein said carrier is formed of a ferrite particle coated with a silicone resin.

6. A developing device as claimed in claim 1 wherein said carrier has a mean particle diameter of 40–80 μm.

7. A developing device as claimed in claim 1 wherein said toner is formed of styrene-acrylic resin, carbon black, load controlling agent, load controlling resin, and offset preventing agent.

8. A developing device for developing an electrostatic latent image formed on a photoreceptor, comprising:

an accommodating portion which accommodates a two-component developer of a toner and a carrier;

a rotatable developing roller confronting said photoreceptor and supplying the developer to said electrostatic latent image on the photoreceptor at a developing region where said developing roller confronts the photoreceptor while holding the developer thereon; and means for providing a developer packaged density (PD) in said developing region at 35–45 when the mean toner particle diameter is 5–8 μm, said developer packaged density (PD) being defined by the following equation:

$$PD=11M/(\rho \cdot D_s)$$

wherein:

M is an amount of developer on the developing roller per unit of surface area (g/cm$^2$)

$\rho$ is the carriers true specific gravity (g/cm$^3$), and $D_s$ is a spacing between the developing roller and the photoreceptor (cm).

9. A developing device as claimed in claim 8 further comprising a blade member which regulates an amount of the developer held on the developing roller.

10. A developing device as claimed in claim 8 wherein the developing roller has a magnetic roller fixed inside thereof.

11. A developing device as claimed in claim 10 wherein a magnetic pole of said magnetic roller confronts the photoreceptor in the developing region.

12. A developing device as claimed in claim 8 wherein said carrier is formed of a ferrite particle coated with a silicone resin.

13. A developing device as claim 8 wherein said carrier has a mean particle diameter of 40–80 μm.

14. A developing device as claimed in claim 8 wherein said toner is formed of styrene-acrylic resin, carbon black, load controlling agent, load controlling resin, and offset preventing agent.

15. A method for developing an electrostatic latent image formed on a photoreceptor, comprising:

providing a two-component developer of a toner having a toner particle diameter of 3–5 μm and a carrier;

supplying the two-component developer to said electrostatic latent image on the photoreceptor at a developing region where a developing roller confronts the photoreceptor; and providing a developer packaged density (PD) in said developing region at 40–50 when the mean toner particle diameter is 3–5 m, said developer packaged density (PD) being defined by the following equation:

$$PD=100M/(\rho \cdot D_s)$$

wherein:

M is an amount of developer on the developing roller per unit of surface area ($g/cm^2$)

$\rho$ is the carrier's true specific gravity ($g/cm^3$), and $D_s$ is a spacing between the developing roller and the photoreceptor (cm).

16. The method for developing an electrostatic latent image of claim 15 further comprising a step of regulating an amount of developer held on the developing roller with a blade.

17. A method for developing an electrostatic latent image formed on a photoreceptor, comprising:

providing a two-component developer of a toner having a mean toner particle diameter of 5–8 μm and a carrier;

supplying the two-component developer to said electrostatic latent image on the photoreceptor at a developing region where a developing roller confronts the photoreceptor; and providing a developer packaged density (PD) in said developing region at 35–45 when the mean toner particle diameter is 5–8 μm, said developer packaged density (PD) being defined by the following equation:

$$PD=100M/(\rho \cdot D_s)$$

wherein:

M is an amount of developer on the developing roller per unit of surface area ($g/cm^2$)

$\rho$ is the carrier's true specific gravity ($g/cm^3$), and $D_s$ is a spacing between the developing roller and the photoreceptor (cm).

18. The method for developing an electrostatic latent image of claim 17, further comprising a step of regulating an amount of developer held on the developing roller with a blade.

* * * * *